US009217187B2

(12) United States Patent
Brady et al.

(10) Patent No.: US 9,217,187 B2
(45) Date of Patent: Dec. 22, 2015

(54) MAGNETIC FIELD ANNEALING FOR IMPROVED CREEP RESISTANCE

(75) Inventors: Michael P. Brady, Oak Ridge, TN (US); Gail M. Ludtka, Oak Ridge, TN (US); Gerard M. Ludtka, Oak Ridge, TN (US); Govindarajan Muralidharan, Knoxville, TN (US); Don M. Nicholson, Oak Ridge, TN (US); Orlando Rios, Knoxville, TN (US); Yukinori Yamamoto, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 762 days.

(21) Appl. No.: 13/553,940

(22) Filed: Jul. 20, 2012

(65) Prior Publication Data

US 2014/0020797 A1 Jan. 23, 2014

(51) Int. Cl.
*C21D 1/18* (2006.01)
*C22C 38/00* (2006.01)
(Continued)

(52) U.S. Cl.
CPC .. *C21D 6/02* (2013.01); *C21D 1/26* (2013.01); *C22C 1/02* (2013.01); *C22C 19/03* (2013.01);
(Continued)

(58) Field of Classification Search
CPC ..... C21D 1/04
USPC ..... 148/100, 102, 103, 104, 105, 108, 110, 148/111, 120, 121, 122, 328, 409, 565
See application file for complete search history.

(56) References Cited

U.S. PATENT DOCUMENTS 5,135,588 A 8/1992 Okiyama et al.
5,885,370 A * 3/1999 Shimotomai ..... C21D 1/04 148/108

(Continued)

FOREIGN PATENT DOCUMENTS

CN 101148713 12/2010
JP 04301079 A * 10/1992 ..... C23C 22/00

(Continued)

OTHER PUBLICATIONS

Sheng et al. "Preliminary investigation on strong magnetic field treated NiAl—Cr(Mo)—Hf near eutectic alloy." Intermetallics 19 (2011) 143-148.*

(Continued)

*Primary Examiner* — Keith Walker
*Assistant Examiner* — Stephani Gulbrandsen
(74) *Attorney, Agent, or Firm* — Novak Druce Connolly Bove + Quigg LLP

(57) ABSTRACT

The method provides heat-resistant chromia- or alumina-forming Fe-, Fe(Ni), Ni(Fe), or Ni-based alloys having improved creep resistance. A precursor is provided containing preselected constituents of a chromia- or alumina-forming Fe-, Fe(Ni), Ni(Fe), or Ni-based alloy, at least one of the constituents for forming a nanoscale precipitate MaXb where M is Cr, Nb, Ti, V, Zr, or Hf, individually and in combination, and X is C, N, O, B, individually and in combination, a=1 to 23 and b=1 to 6. The precursor is annealed at a temperature of 1000-1500° C. for 1-48 h in the presence of a magnetic field of at least 5 Tesla to enhance supersaturation of the $M_aX_b$ constituents in the annealed precursor. This forms nanoscale $M_aX_b$ precipitates for improved creep resistance when the alloy is used at service temperatures of 500-1000° C. Alloys having improved creep resistance are also disclosed.

10 Claims, 8 Drawing Sheets

(51) Int. Cl.

| | |
|---|---|
| ***C22C 19/03*** | (2006.01) |
| ***C22F 1/10*** | (2006.01) |
| ***C21D 6/02*** | (2006.01) |
| ***C21D 1/26*** | (2006.01) |
| ***C22C 30/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 1/02*** | (2006.01) |

(52) U.S. Cl.

CPC ..... *C22C 30/00* (2013.01); *C22C 38/00* (2013.01); *C22C 38/42* (2013.01); *C22C 38/44* (2013.01); *C22C 38/46* (2013.01); *C22C 38/48* (2013.01); *C22C 38/50* (2013.01); *C21D 1/18* (2013.01); *C21D 2201/03* (2013.01); *C21D 2211/004* (2013.01); *C21D 2281/00* (2013.01); *C22F 1/10* (2013.01)

(56) References Cited

U.S. PATENT DOCUMENTS

| | | | | |
|---|---|---|---|---|
| 5,916,382 | A | 6/1999 | Sato et al. | |
| 6,702,905 | B1 | 3/2004 | Qiao et al. | |
| 6,773,513 | B2 * | 8/2004 | Ludtka | C21D 1/04 148/108 |
| 7,063,752 | B2 * | 6/2006 | Koo | C21D 1/04 148/103 |
| 2004/0221925 | A1 * | 11/2004 | Tamaki et al. | 148/410 |
| 2005/0053513 | A1 | 3/2005 | Pike | |
| 2008/0126383 | A1 | 5/2008 | Perrin et al. | |
| 2008/0318083 | A1 | 12/2008 | Berns et al. | |

FOREIGN PATENT DOCUMENTS

| | | | |
|---|---|---|---|
| JP | 10324961 | | 12/1998 |
| JP | 2008027278 | A * | 2/2008 |

OTHER PUBLICATIONS

Niu et al. "The third-element effect in the oxidation of Ni-xCr-7Al (x=0, 5, 10, 15 at.%) alloys in 1 atm O2 at 900-1000° C." Corrosion Science 48 (2006) 4020-4036.*

Gayda et al. "Quench crack behavior of nickel-base disk superalloys." Practical Failure Analysis 3 (2003) 55-59.*

JP 2008027278 A machine translation.*

JP 04301079 A English abstract.*

Ohnuma et al. "Optimization of the microstructure and properties of Co-substituted Fe—Si—B—Nb—Cu nanocrystalline soft magnetic alloys," Journal Of Applied Physics, Jun. 1, 2003, vol. 93 No. 11 p. 9186-9194.

Ma et al., "Application of high magnetic fields in advanced materials processing," Chinese Science Bulletin 2006 vol. 51 No. 24 p. 2944-2950.

Garmestani, "High temperature texturing of engineered materials in a magnetic field," U.S. Army Research Office Report.

International Search Report and the Written Opinion mailed on Nov. 14, 2014 in International Application No. PCT/ US2014/47769. (12 pages).

* cited by examiner

MAGNETIC FIELD ANNEALING FOR IMPROVED CREEP RESISTANCE

STATEMENT REGARDING FEDERALLY SPONSORED RESEARCH

This invention was made with government support under contract No. DE-AC05-00OR22725 awarded by the U.S. Department of Energy. The government has certain rights in this invention.

FIELD OF THE INVENTION

This invention relates to heat resistant chromia or alumina forming Fe, Fe(Ni), Ni(Fe), or Ni based alloys having improved creep resistance.

BACKGROUND OF THE INVENTION

Solutionizing of heat resistant Fe and Ni base alloys is currently performed by controlled temperature anneals. The greater the extent of solutionizing of key elements during alloy processing, the better the subsequent creep resistance can be. The solutionizing process raises the temperature of the alloy to dissolve and uniformly distribute alloying elements including those that will form the desired creep resistance imparting precipitates. The temperature is thereafter lowered and the precipitate compounds, which are not soluble in the alloy at lower temperatures, form nanoscale precipitates which improve some properties of the alloys. A significant such property is the creep resistance of the alloy at the service temperature of the alloy. Typical such service temperatures can be between 500-1000° C.

SUMMARY OF THE INVENTION

A method of making a heat-resistant chromia- or alumina-forming Fe-, Fe(Ni), Ni(Fe), or Ni-based alloy having improved creep resistance includes the step of providing a precursor containing preselected constituents of a chromia- or alumina-forming Fe-, Fe(Ni), Ni(Fe), or Ni-based alloy. At least one of the constituents forms a nanoscale precipitate $M_aX_b$ where M is Cr, Nb, Ti, V, Zr, Hf individually or in combination, X is C, N, O, B individually or in combination, and a=1 to 23 and b=1 to 6. The precursor is annealed at a temperature of 1000-1500° C. for 1-48 h in the presence of a magnetic field of at least 5 Tesla to enhance supersaturation of the $M_aX_b$ constituents in the annealed precursor in order to form nanoscale $M_aX_b$ precipitates for improved creep resistance when the alloy is used at service temperatures of 500-1000° C.

The magnetic field can be between 5-30 Tesla. The magnetic field can be between 8-10 Tesla. The anneal can be performed at a temperature between 1100° C. and 1250° C. The anneal step can be 22-24 h and can be followed by a rapid cooling process comprising contacting the alloy with a cooling fluid to cool the alloy to room temperature in less than 15 minutes.

A method of making a heat resistant chromia- or alumina-forming Fe-, Fe(Ni), Ni(Fe), or Ni-based alloy having improved creep resistance can include the step of providing a precursor containing preselected constituents of a chromia- or alumina-forming Fe-, Fe(Ni), Ni(Fe), or Ni-based alloy, at least one of the constituents including a hafnium addition. The precursor is annealed at a temperature of 1000-1500° C. for 1-48 h in the presence of a magnetic field of at least 5 Tesla to supersaturate the annealed precursor with at least one element selected from the group of C, N, O, and B, individually or in combination, in order to form at least one nanoscale precipitate selected from the group consisting of hafnium carbides, hafnium nitrides, hafnium carbonitrides, hafnium oxides, and hafnium borides.

The magnetic field can be between 5-30 Tesla. The magnetic field can be between 8-10 Tesla. The anneal can be performed at a temperature between 1100° C. and 1250° C. The anneal step can be 22-24 hr.

A chromia- or alumina-forming Fe-, Fe(Ni), Ni(Fe), or Ni-based alloy has at least one nanoscale precipitate $M_aX_b$ where M is Cr, Nb, Ti, V, Zr, Hf individually or in combination, and X is C, N, O, B individually or in combination, where a=1 to 23 and b=1 to 6, emanating from supersaturation of at least one element selected from the group of C, N, O, and B during a solutionizing anneal between 1000-1500° C. under a magnetic field of at least 5 T.

A chromia- or alumina-forming Fe-, Fe(Ni), Ni(Fe), or Ni-based alloy having at least one nanoscale precipitate selected from the group hafnium carbides, hafnium nitrides, hafnium carbonitrides, hafnium oxides, and hafnium borides, emanating from supersaturation of at least one element selected from the group of C, N, O, and B individually or in combination during a solutionizing anneal between 1000-1500° C. under a magnetic field of at least 5 T.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
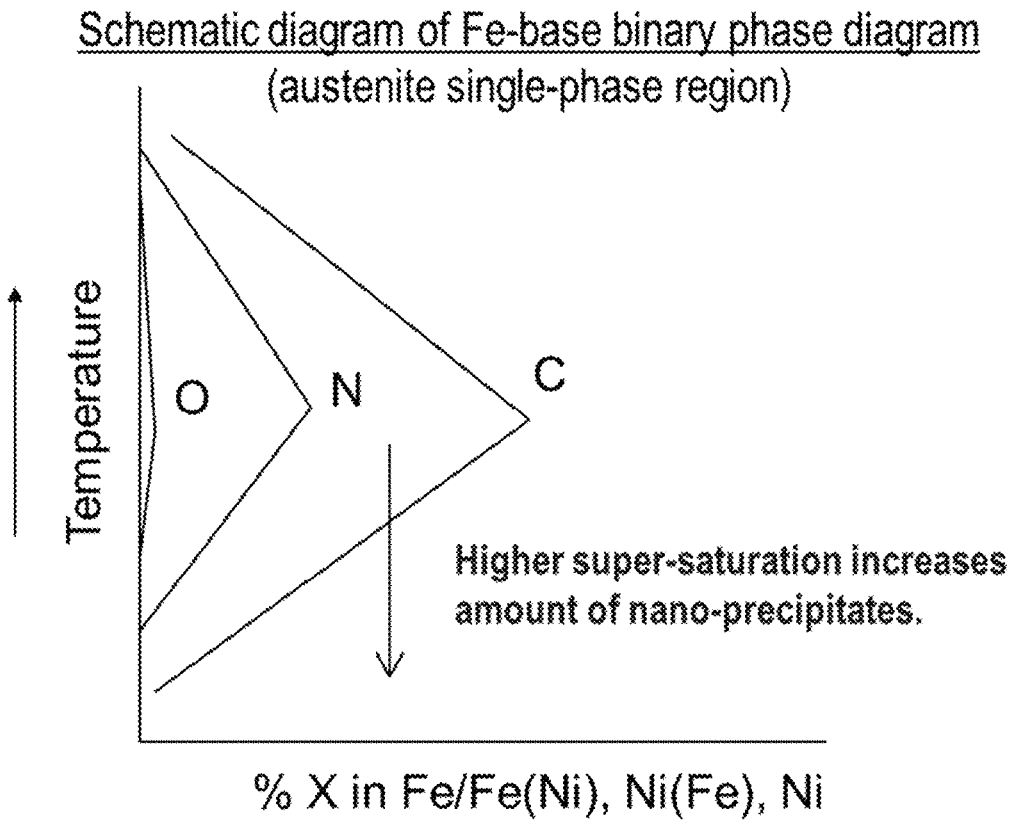
FIG. 1 is a schematic phase diagram showing the principle of solution treatment at high temperature to supersaturate C, N, or O to form strengthening precipitates on exposure to lower temperature.

This invention is related to processing of alloys for heat resistant applications. The method includes a solutionizing annealing in the presence of a strong magnetic field, which changes the phase equilibria of the material during the solutionizing anneal to permit more extensive supersaturation of key strengthening additives in Fe and Ni base high temperature alloys. It is particularly applicable to carbide and nitride strengthened materials. These changes result in enhanced volume fractions of nanostrengthening precipitates during service, which have the effect of improving creep resistance.

The method provides heat-resistant chromia- or alumina-forming Fe-, Fe(Ni), Ni(Fe), or Ni-based alloys having improved creep resistance. A precursor is provided containing preselected constituents of a chromia- or alumina-forming Fe-, Fe(Ni), Ni(Fe), or Ni-based alloy, at least one of the constituents for forming nanoscale precipitates $M_aX_b$ where M is Cr, Nb, Ti, V, Zr, or Hf, individually and in combination, and X is C, N, O, or B, individually and in combination, a is 1 to 23 and b is 1 to 6. The precursor is annealed at a temperature of 1000-1500° C. for 1-48 h in the presence of a magnetic field of at least 5 Tesla to enhance supersaturation of the MX constituents in the annealed precursor. Quench cooling is preferred under the magnetic field but can also be done outside of the magnetic field. This treatment forms nanoscale $M_aX_b$ precipitates for improved creep resistance when the alloy is used at service temperatures, typically in the range of 500-1000° C.

The magnetic field should be at least 5 Tesla. The magnetic field can be at least 6 T, 7 T, 8 T, 9 T, 10 T, 20 T, 30 T or higher. In one aspect of the invention, the magnetic field is between 5-10 T. In another aspect, the magnetic field is between 8-10 T. Higher magnetic fields are possible with the improvement of industrial scale magnetic field equipment. The use of cryogen-recondensing, superconducting magnet systems is preferable since, once in persistent mode, no more energy is required to keep the magnet at full field strength making this a very, energy-efficient process and unlike resistance ("Bitter") magnet systems that require megawatts of energy and massive cooling systems to maintain field strengths of >5 T.

The anneal can be performed at any suitable temperature. The anneal can be conducted between 1000° C. and 1500° C., although other suitable anneal temperatures are possible. In one example, the anneal is performed at a temperature between 1100° C. and 1250° C. The anneal can also be performed for any suitable duration. The anneal can have a duration of between 1-48 hours, although any suitable duration is possible. In one example, the anneal step is 22-24 hr. After the annealing process, the alloys need to be cooled as rapidly as possible to room temperature in order to retain the $M_aX_b$ supersaturation as much as possible. The cooling can be performed by quenching into water, blowing inert gas such as helium, nitrogen, and argon, and blowing air, which typically yields cooling rates on the order of a few seconds to a few minutes. Faster cooling favors increased $M_aX_b$ supersaturation. The rapid cooling can be less than 15 minutes, or less than 5 minutes, or less than 1 minute. The cooling can be performed both with and without the magnetic field, although cooling under magnetic field is preferred to assist in maintaining the greatest extent of $M_aX_b$ supersaturation.

The examples herein describe the effect of solution annealing in a high magnetic field on creep rupture life of austenitic stainless steels. Examples are specifically shown for alumina-forming austenitic (AFA) alloys. However, the invention is also applicable to many heat resistant Fe, Fe(Ni), Ni(Fe), and Ni based alloys, both chromia or alumina forming, that rely on solution treating to supersaturate C, N, O, or B, individually or in combination, in order to precipitate nanoscale carbides, nitrides, carbo-nitrides, oxides, and/or related C—N—O precipitates. Examples of such strengthening phases include, but are not limited to, $M_aX_b$ phases, where M=Cr, Nb, Ti, V, Zr, Hf, individually and in combination, and X=C, N, O, or B, individually and in combination. The $M_aX_b$ precipitates include well known strengthening phases such as $M_{23}X_6$ $M_6X$, and MX phases. FIG. 1 shows a simplified schematic of solution annealing and precipitation of C, N, and O precipitates to achieve creep strength. This schematic phase diagram illustrates the principle of solution treatment at high temperature to supersaturate C, N, or O to form strengthening precipitates on exposure to lower temperatures. Similar trends hold for B as well.

Solutionizing temperatures depend on the specific base alloy composition, but are generally in range of 1000-1500° C. In one aspect, the solutionizing temperature is between 1100-1250° C. The carbide, nitride, oxide phase(s) then precipitate out at the service temperature (typically 500-1000° C.) to provide creep resistance during service. In general, in order of decreasing high temperature solubility in Fe/Ni alloys are: C, N, and B/O. The greater the solubility and potential supersaturation, the greater the opportunity to form a high volume fraction of strengthening nanoprecipitates to achieve creep resistance. Enhanced creep resistance is possible if the application of a magnetic field can modify phase equilibria and increase the solubility/supersaturation of C, N, O, and/or B.

The use of a magnetic field to impact solutionizing phase equilibria can also permit annealing to be performed at lower temperatures and/or shorter times to achieve a given level of nanoprecipitate volume fraction and creep resistance. Lower temperature and/or shorter time annealing can result in significant process cost savings or longer heat-treatment equipment lifetime. Alternatively, if lower alloy amounts of C, N, O, or B can be used to achieve a given level of creep resistance by use of magnetic field annealing, then additional advantages such as improved toughness due to lower total carbide volume fraction with lower C, for example, can result.

Figure 2:
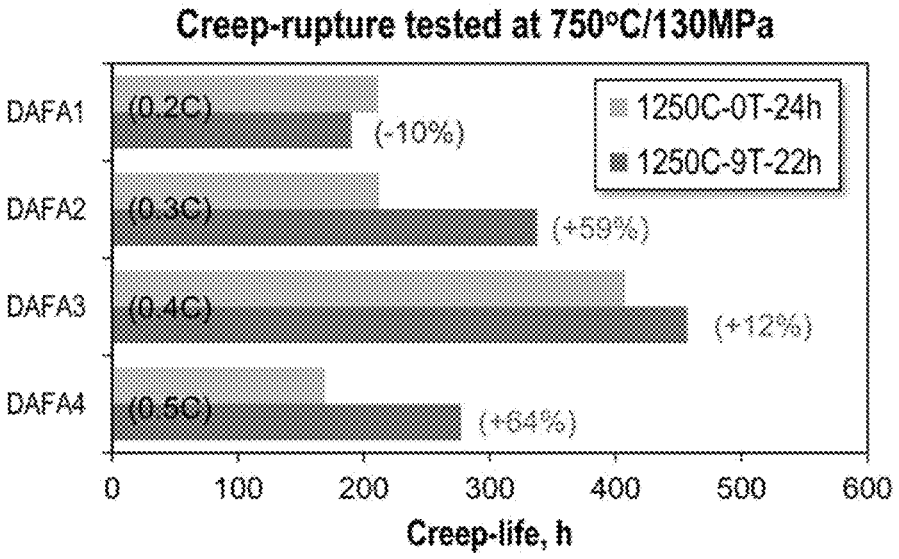
FIG. 2 is a plot of creep-rupture life of the 1250° C. solution annealed DAFA1~4 alloys tested at 750° C. and 130 MPa.

Table 1 shows nominal and analyzed compositions for four AFA alloys (DAFA 1-4) and a base alloy (OC4) as a function of C content. These alloys were annealed at 1250° C. for 22-24 h without an applied magnetic field (0 T) and with a 9 T magnetic field applied, followed by water- or helium gas-quenching (quenched under field for the 9 T sample). Microstructure analysis suggested that the 9 T magnetic field lowered the melting point of the highest C DAFA 4 alloy. Creep rupture life data for these alloys at an aggressive screening condition of 750° C. and 130 MPa are shown in FIG. 2. The creep life of the lower (0.2) C DAFA 1 alloy showed decreased life with the 9 T magnetic solutionizing anneal, whereas the higher C alloys exhibited lifetime improvements ranging from 12-64% with magnetic field annealing.

TABLE 1

| Name | Fe | Cr | Mn | Ni | Cu | Al | Si | Nb | V | Ti | Mo |
|---|---|---|---|---|---|---|---|---|---|---|---|
| | Nominal composition, wt % | | | | | | | | | | |
| OC4 (base) | 49.12 | 14 | 2 | 25 | 0.5 | 3.5 | 0.15 | 2.50 | 0.05 | 0.05 | 2 |
| DAFA1 | 49.72 | 14 | 2 | 25 | 0.5 | 3.5 | 1 | 0.95 | 0.05 | 0.05 | 2 |
| DAFA2 | 49.62 | 14 | 2 | 25 | 0.5 | 3.5 | 1 | 0.95 | 0.05 | 0.05 | 2 |
| DAFA3 | 49.52 | 14 | 2 | 25 | 0.5 | 3.5 | 1 | 0.95 | 0.05 | 0.05 | 2 |
| DAFA4 | 49.42 | 14 | 2 | 25 | 0.5 | 3.5 | 1 | 0.95 | 0.05 | 0.05 | 2 |

TABLE 1-continued

| | Analyzed composition, wt % | | | | | | | | | | |
|---|---|---|---|---|---|---|---|---|---|---|---|
| OC4 (base) | 49.14 | 13.88 | 1.94 | 25.21 | 0.50 | 3.47 | 0.15 | 2.49 | 0.05 | 0.05 | 2.00 |
| DAFA1 | 49.67 | 14.04 | 1.92 | 25.10 | 0.51 | 3.56 | 0.94 | 0.95 | 0.05 | 0.05 | 1.98 |
| DAFA2 | 49.86 | 14.11 | 1.92 | 25.28 | 0.51 | 3.49 | 0.48 | 0.94 | 0.05 | 0.05 | 1.98 |
| DAFA3 | 49.51 | 13.90 | 1.90 | 25.53 | 0.48 | 3.44 | 0.95 | 0.91 | 0.05 | 0.02 | 1.98 |
| DAFA4 | 49.27 | 13.91 | 1.95 | 25.51 | 0.48 | 3.51 | 0.98 | 0.88 | 0.05 | 0.03 | 1.99 |

| Name | W | C | B | P | S | O | N | Remarks |
|---|---|---|---|---|---|---|---|---|
| | Nominal composition, wt % | | | | | | | |
| OC4 (base) | 1 | 0.1 | 0.01 | 0.02 | — | — | — | base |
| DAFA1 | 1 | 0.2 | 0.01 | 0.02 | — | — | — | 0.2 C |
| DAFA2 | 1 | 0.3 | 0.01 | 0.02 | — | — | — | 0.3 C |
| DAFA3 | 1 | 0.4 | 0.01 | 0.02 | — | — | — | 0.4 C |
| DAFA4 | 1 | 0.5 | 0.01 | 0.02 | — | — | — | 0.5 C |
| | Analyzed composition, wt % | | | | | | | |
| OC4 (base) | 1.00 | 0.091 | 0.006 | 0.019 | — | 0.0009 | 0.0005 | base |
| DAFA1 | 0.99 | 0.200 | 0.009 | 0.020 | 0.0011 | 0.0007 | 0.0005 | 0.2 C |
| DAFA2 | 1.00 | 0.290 | 0.008 | 0.020 | 0.0013 | 0.0008 | 0.0012 | 0.3 C |
| DAFA3 | 0.96 | 0.342 | 0.006 | 0.005 | 0.0009 | 0.0014 | 0.0006 | 0.4 C |
| DAFA4 | 0.97 | 0.452 | 0.008 | 0.003 | 0.0006 | 0.0009 | 0.0004 | 0.5 C |

Table 2 shows nominal and analyzed compositions for a second series of AFA alloys which attempt to use N/nitrides for strengthening instead of C. The alloys in Table 2 present nominal and analyzed compositions of a series of nitride strengthened stainless steels (no carbon) as a function of N, Ti, Zr, and Hf additions.

TABLE 2

| Name | Fe | Cr | Mn | Ni | Al | Si | Nb | Ti | Mo | Zr | Hf | C | B | S | O | N | Remarks |
|---|---|---|---|---|---|---|---|---|---|---|---|---|---|---|---|---|---|
| | Nominal composition, wt % | | | | | | | | | | | | | | | | |
| DAFA20 | 52.72 | 14 | 2 | 25 | 3 | 0.15 | 1 | — | 2 | — | — | — | 0.01 | | | 0.12 | base alloy |
| DAFA21 | 52.42 | 14 | 2 | 25 | 3 | 0.15 | 1 | 0.30 | 2 | — | — | — | 0.01 | | | 0.12 | 0.3 at % Ti + 0.3 at % N |
| DAFA22 | 52.22 | 14 | 2 | 25 | 3 | 0.15 | 1 | — | 2 | 0.50 | — | — | 0.01 | | | 0.12 | 0.3 at % Zr + 0.3 at % N |
| DAFA23 | 51.72 | 14 | 2 | 25 | 3 | 0.15 | 1 | — | 2 | — | 1.00 | — | 0.01 | | | 0.12 | 0.3 at % Hf + 0.3 at % N |
| | Analyzed composition, wt % | | | | | | | | | | | | | | | | |
| DAFA20 | 52.38 | 14.11 | 1.88 | 25.48 | 2.92 | 0.13 | 1.00 | 0.02 | 2.00 | 0.01 | — | 0.002 | 0.007 | 0.0013 | 0.0009 | 0.0438 | base alloy |
| DAFA21 | 52.30 | 14.17 | 1.85 | 25.31 | 2.97 | 0.13 | 0.97 | 0.24 | 1.97 | 0.01 | — | 0.002 | 0.008 | — | 0.0019 | 0.0536 | 0.27 at. % Ti + 0.21 at. % N |
| DAFA22 | 52.02 | 14.15 | 1.87 | 25.44 | 2.99 | 0.14 | 0.98 | 0.01 | 1.97 | 0.36 | — | 0.002 | 0.006 | 0.0012 | 0.0013 | 0.0475 | 0.22 at. % Zr + 0.19 at. % N |
| DAFA23 | 51.71 | 14.22 | 1.89 | 25.42 | 2.90 | 0.13 | 0.93 | — | 1.92 | 0.02 | 0.61 | 0.002 | 0.008 | 0.0021 | 0.0025 | 0.0530 | 0.19 t % Hf + 0.20 at % N |

Figure 3:
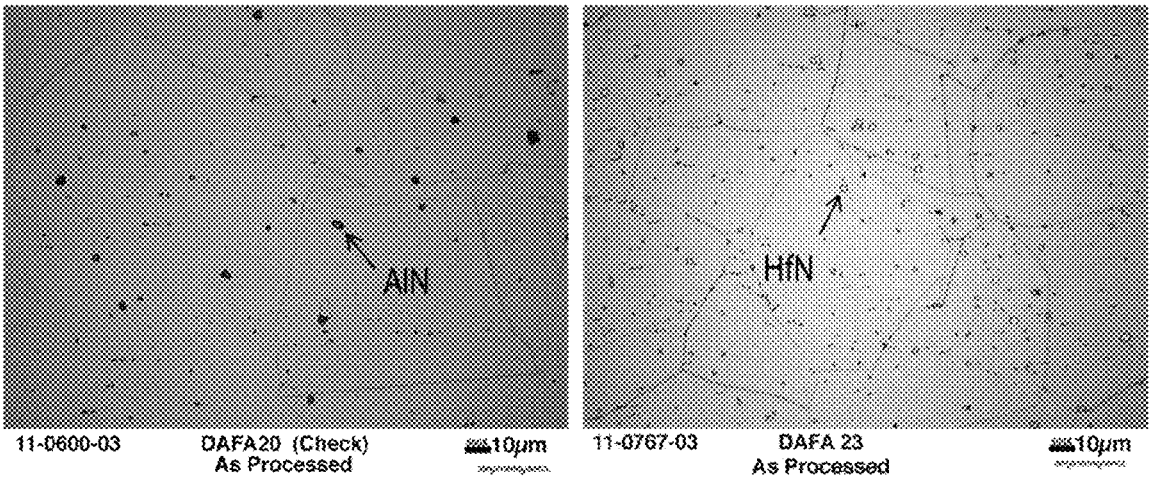
FIG. 3 is a series of optical micrographs showing that the Hf in DAFA 23 prevented the AlN formation observed in the baseline alloy DAFA 20.

To getter the N away from the Al in order to avoid formation of detrimental coarse AlN precipitates, additions of Hf, Ti, and Zr are used. The use of hafnium results in the formation of precipitates of hafnium carbides, hafnium nitrides, hafnium carbonitrides, hafnium oxides, and hafnium borides. These elements can be more thermodynamically stable with N than Al. As shown in FIG. 3, addition of more N active elements such as Hf prevents formation of AlN, which can be detrimental to both creep resistance and oxidation resistance. FIG. 3 presents optical micrographs which show that Hf in DAFA 23 prevented the AlN formation that was observed in baseline alloy DAFA 20.

Figure 4:
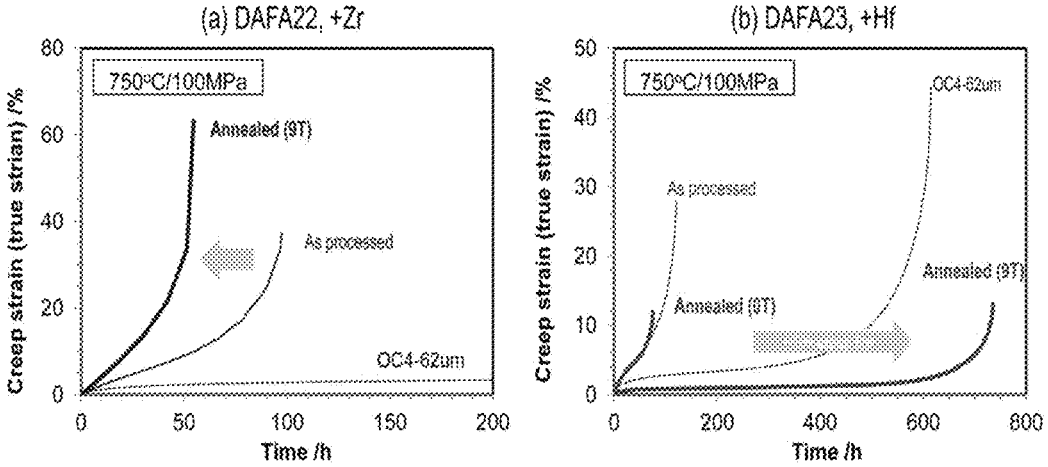
FIG. 4 are creep curves at 750° C. and 100 MPa of (a) DAFA22 and (b) DAFA23, showing the effect of magnetic field annealing on the creep properties of the alloys. The creep curve of OC4 (baseline AFA) is also shown for comparison.

Creep rupture life data for the nitrogen added AFA alloys of Table 2 tested at 750° C. and 100 MPa with and without a 9 T solution anneal is summarized in Table 3 and FIG. 4. The baseline DAFA 20 alloy and the Ti and Zr added alloys (DAFA 21 and 22) exhibited poor creep rupture lifetimes both as processed and after annealing in a 9 T magnetic field. However, alloy DAFA 23 with the Hf and N addition showed a significant increase in creep rupture lifetime, from 121 h as-processed and 75 h with a 0 T anneal to 736 h with a 9 T magnetic field anneal, an increase in rupture life of 6-10×. It should be noted that the DAFA 23 alloy without magnetic field annealing exhibited poor creep resistance. This improvement from poor to good creep resistance demonstrates the potential for significant effects of the magnetic annealing of the invention.

TABLE 3

| Samples | Creep-rupture life at 750° C./100 MPa, h | | | Remarks |
|---|---|---|---|---|
| | As processed | 0 T annealed | 9 T annealed | |
| Base (DAFA20) | 51 | — | 55 | annealed at 1100° C./22 h |
| +Ti (DAFA21) | 66 | — | 53 | annealed at 1100° C./22 h |
| +Zr (DAFA22) | 97 | — | 55 | annealed at 1100° C./22 h |

TABLE 3-continued

| Samples | Creep-rupture life at 750° C./100 MPa, h | | | Remarks |
|---|---|---|---|---|
| | As processed | 0 T annealed | 9 T annealed | |
| +Hf (DAFA23) | 121 | 75 | 736 | annealed at 1200° C./22 h |

Figure 5:
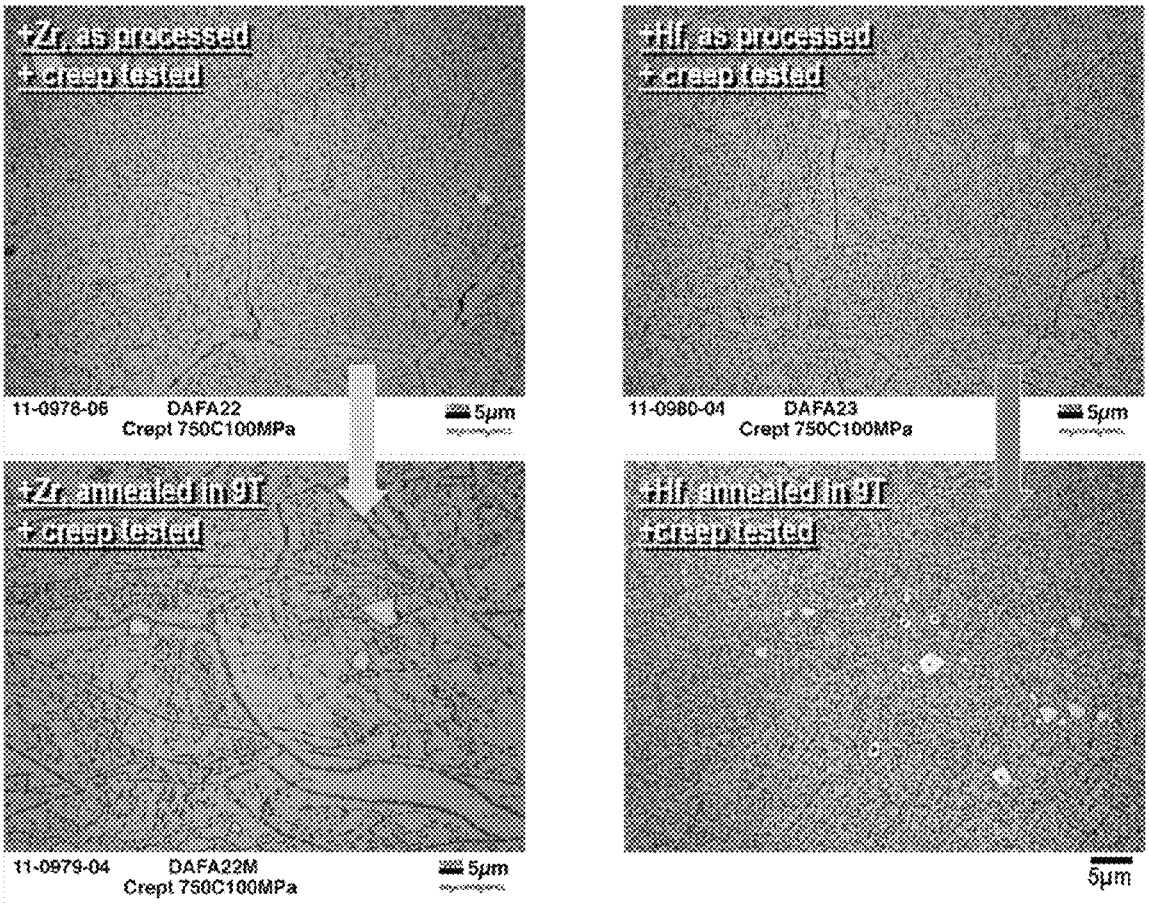
FIG. 5 are optical micrographs of DAFA 22 (+Zr) and DAFA 23 (+Hf) comparing structure after creep with and without magnetic field annealing.
Figure 6:
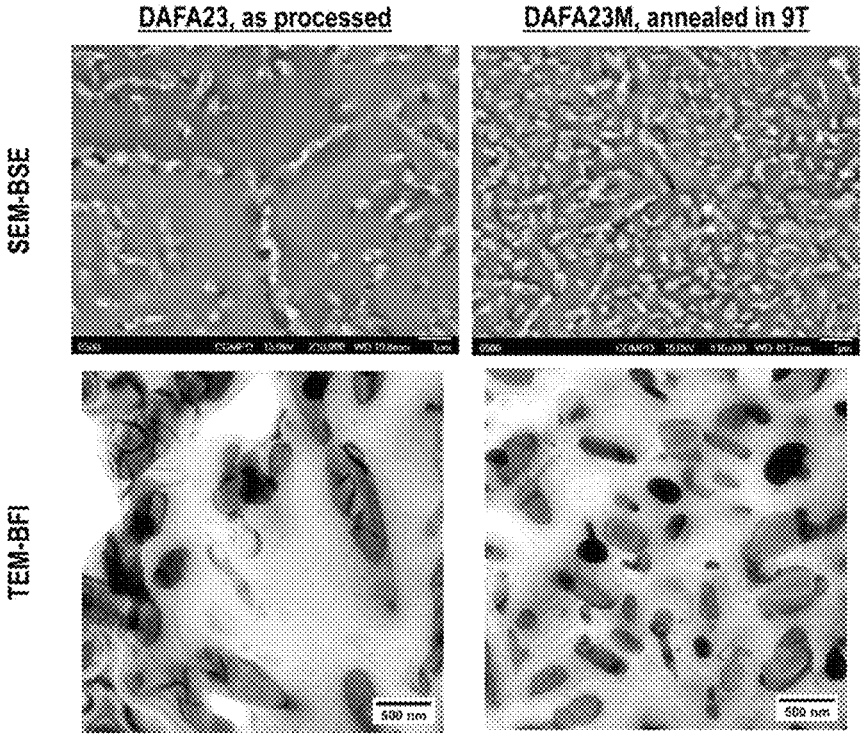
FIG. 6 are SEM-BSE and TEM-BF images of creep-ruptured DAFA23 specimen (as hot-rolled or mag-annealed in 9 T) at 750° C. and 100 MPa.
Figure 7:
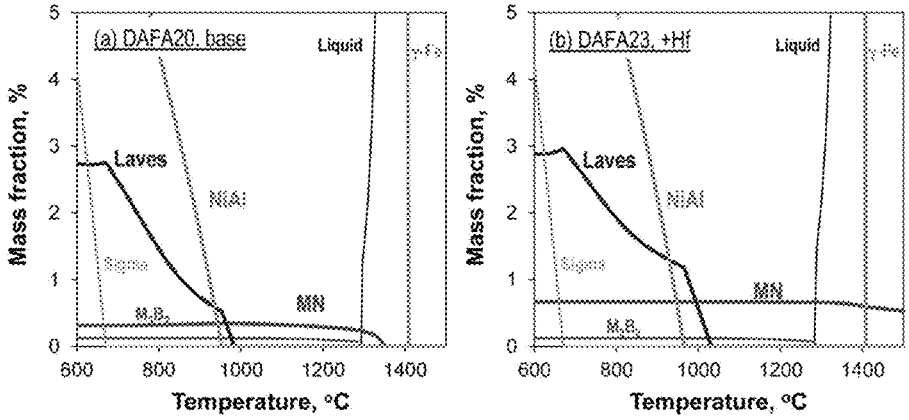
FIG. 7 is computational thermodynamic calculation of phase equilibria in baseline alloy DAFA20 and Hf modified alloy DAFA23.

FIG. 5 shows optical micrographs after creep testing for DAFA 22 (Zr) and DAFA 23 (Hf) as processed and after magnetic field anneal. The DAFA 23 showed a significant increase in fine precipitate density in the magnetic field annealed sample, consistent with the improved creep rupture life, which was confirmed in TEM imaging (FIG. 6). Computational thermodynamic assessment (FIG. 7) suggests that DAFA 23 should have a relatively high volume fraction of MN phase (M primarily Hf), although preliminary TEM imaging did not find definitive evidence of nanoscale nitride (or Hf-nitride) strengthening. It is possible that very fine nitride particles or nanoclusters (<5 nm) may have been formed but are not evident in the TEM sections shown in FIG. 6. It is also possible that the magnetic field annealing stabilized strengthening nitrogen and/or boron containing phases(s) not predicted from the thermodynamic calculations and/or sufficiently altered the nature of the $B_2$—NiAl and $Fe_2$(Nb,Mo) Laves phase second phase precipitates to enhance their strengthening effects. Very small (<5 nm) precipitates or nonequilibrium phases could be formed to improving creep strength.

Figure 8:
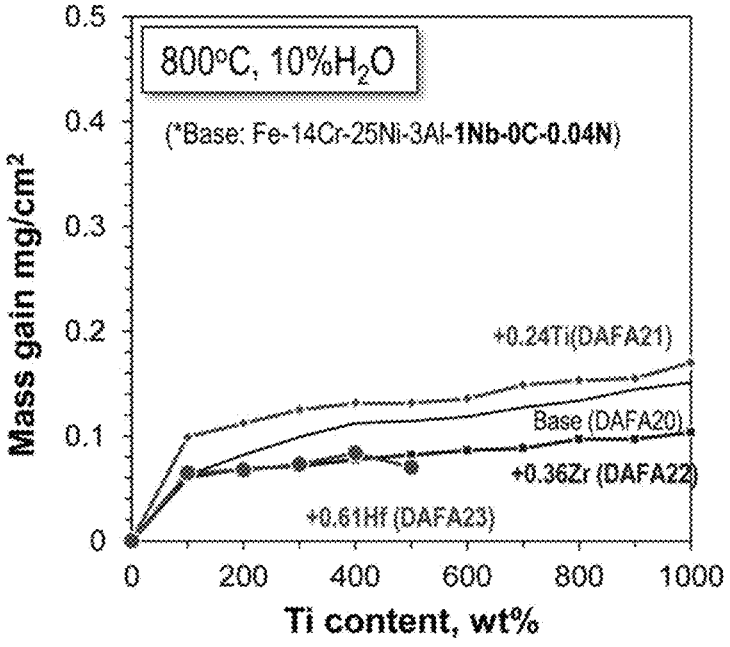
FIG. 8 is oxidation data for DAFA 20-23 alloys at 800° C. in air with 10 volume percent water vapor.

Oxidation data (FIG. 8) confirms that the DAFA 20-23 series alloys exhibit excellent oxidation resistance consistent with protective alumina scale formation at 800° C. in air with 10% water vapor, an aggressive screening condition.

Cumulatively, the results show that solution annealing in a high magnetic field can beneficially impact subsequent creep properties by modifying alloy solubility and phase stability. The extent of impact appears to depend on alloy composition, with the strongest effects observed to date with Hf and N additions.

The foregoing description of the preferred embodiments of the invention has been presented for purposes of illustration. The invention is not limited to the embodiments disclosed. Modifications and variations to the disclosed embodiments are possible and within the scope of the invention.

We claim:

1. A method of making a heat-resistant chromia- or alumina-forming Fe-, Fe(Ni), Ni(Fe), or Ni-based alloy having improved creep resistance comprising the steps of:

providing a precursor containing preselected constituents of a chromia- or alumina-forming Fe-, Fe(Ni), Ni(Fe), or Ni-based alloy, at least one of the constituents for forming a nanoscale precipitate $M_aX_b$ where M is Cr, Nb, Ti, V, Zr, Hf individually or in combination, X is C, N, O, B individually or in combination, and a=1 to 23 and b=1 to 6;

single-phase austenite matrix phase solid solution annealing the precursor at a temperature of 1000-1500° C. for 1-48 h in the presence of a magnetic field of at least 5 Tesla to enhance supersaturation of the $M_aX_b$ constituents in the annealed precursor in order to form nanoscale $M_aX_b$ precipitates for improved creep resistance when the alloy is used at service temperatures of 500-1000° C.

2. The method of claim 1, wherein the magnetic field is between 5-30 Tesla.

3. The method of claim 1, wherein the magnetic field is between 8-10 Tesla.

4. The method of claim 1, wherein said anneal is performed at a temperature between 1100° C. and 1250° C.

5. The method of claim 1, wherein said anneal step is 22-24 h and is followed by a rapid cooling process comprising contacting the alloy with a cooling fluid to cool the alloy to room temperature in less than 15 minutes.

6. A method of making a heat resistant chromia- or alumina-forming Fe-, Fe(Ni), Ni(Fe), or Ni-based alloy having improved creep resistance comprising the steps of:

providing a precursor containing preselected constituents of a chromia- or alumina-forming Fe-, Fe(Ni), Ni(Fe), or Ni-based alloy, at least one of the constituents including a hafnium addition;

single-phase austenite matrix phase solid solution annealing the precursor at a temperature of 1000-1500° C. for 1-48 h in the presence of a magnetic field of at least 5 Tesla to supersaturate the annealed precursor with at least one element selected from the group of C, N, O, and B, individually or in combination, in order to form at least one nanoscale precipitate selected from the group consisting of hafnium carbides, hafnium nitrides, hafnium carbonitrides, hafnium oxides, and hafnium borides.

7. The method of claim 6, wherein the magnetic field is between 5-30 Tesla.

8. The method of claim 6, wherein the magnetic field is between 8-10 Tesla.

9. The method of claim 6, wherein said anneal is performed at a temperature between 1100° C. and 1250° C.

10. The method of claim 6, wherein said anneal step is 22-24 hr.

* * * * *